US009243786B1

(12) United States Patent
Onda et al.

(10) Patent No.: US 9,243,786 B1
(45) Date of Patent: Jan. 26, 2016

(54) LIGHT ASSEMBLY

(71) Applicant: ABL IP Holding LLC, Conyers, GA (US)

(72) Inventors: Joseph L. Onda, Lawrenceville, GA (US); Douglas Dewayne Grove, Grayson, GA (US); Carl Jason Schoeneberg, Decatur, GA (US)

(73) Assignee: ABL IP Holding LLC, Conyers, GA (US)

( * ) Notice: Subject to any disclaimer, the term of this patent is extended or adjusted under 35 U.S.C. 154(b) by 0 days.

(21) Appl. No.: 14/463,929

(22) Filed: Aug. 20, 2014

(51) Int. Cl.

| | |
|---|---|
| ***F21V 21/30*** | (2006.01) |
| ***F21V 21/03*** | (2006.01) |
| ***F21V 21/14*** | (2006.01) |
| *F21W 131/30* | (2006.01) |

(52) U.S. Cl.
CPC ..... *F21V 21/03* (2013.01); *F21V 21/14* (2013.01); *F21W 2131/30* (2013.01)

(58) Field of Classification Search
CPC ..... F21S 8/00; F21S 8/026; F21S 8/028
USPC ..... 362/147, 148, 150, 368, 372, 404
See application file for complete search history.

(56) References Cited

U.S. PATENT DOCUMENTS

| | | | | |
|---|---|---|---|---|
| 3,609,346 | A | 9/1971 | Lund et al. | |
| 3,660,651 | A | 5/1972 | Miles, Jr. | |
| 3,974,371 | A | 8/1976 | Miles, Jr. | |
| 4,462,068 | A | 7/1984 | Shadwick | |
| 4,881,157 | A * | 11/1989 | Pahl | F21V 21/04 362/269 |
| 5,207,781 | A | 5/1993 | Röck | |
| 5,291,381 | A | 3/1994 | Price | |
| 5,562,343 | A | 10/1996 | Chan et al. | |
| 5,823,664 | A | 10/1998 | Demshki, Jr. et al. | |
| 6,082,878 | A | 7/2000 | Doubek et al. | |
| 6,120,164 | A | 9/2000 | Libin et al. | |
| 6,402,112 | B1 | 6/2002 | Thomas et al. | |
| 6,461,021 | B1 | 10/2002 | Warnecke | |
| 6,471,374 | B1 | 10/2002 | Thomas et al. | |

(Continued)

FOREIGN PATENT DOCUMENTS

CA 2609531 A1 11/2006

OTHER PUBLICATIONS

Non-Final Office Action for U.S. Appl. No. 13/833,597, mailed Jul. 3, 2014.

(Continued)

*Primary Examiner* — Ali Alavi
(74) *Attorney, Agent, or Firm* — Kilpatrick Townsend & Stockton, LLP

(57) ABSTRACT

Disclosed is a light assembly including a rotation ring including upper and lower surfaces, a mounting ring secured to a light pan and including upper and lower surfaces positioned over a portion of the rotation ring such that the portion of the rotation ring is sandwiched between the light pan and the mounting ring and such that the rotation ring is rotatable relative to the mounting ring, a light engine mounted on the rotation ring, and an adjustable rotation limiting mechanism that includes (a) a rotation stop platform provided on the mounting ring, the rotation stop platform including a moveable stop and (b) a rotation stop unit provided on the rotation ring, the rotation stop unit including a rotation stop arm. The rotation stop arm rotates with the rotation ring and contacts the moveable stop to prevent further rotation of the rotation ring with respect to the mounting ring.

20 Claims, 8 Drawing Sheets

(56) References Cited

U.S. PATENT DOCUMENTS

| | | | | |
|---|---|---|---|---|
| 6,481,871 | B2 * | 11/2002 | Jamison | F21V 21/30 362/287 |
| 6,491,407 | B1 | 12/2002 | Beadle | |
| 6,634,764 | B2 | 10/2003 | Kotovsky et al. | |
| 6,652,124 | B2 | 11/2003 | Schubert et al. | |
| 6,719,438 | B2 | 4/2004 | Sevack et al. | |
| 6,860,624 | B2 | 3/2005 | Hille et al. | |
| 6,926,427 | B2 | 8/2005 | Tawil et al. | |
| 6,953,270 | B1 | 10/2005 | Richardson | |
| 7,182,496 | B2 | 2/2007 | Ruffin | |
| 7,213,940 | B1 | 5/2007 | Van De Ven et al. | |
| 7,316,359 | B2 | 1/2008 | Beidokhti | |
| 7,431,482 | B1 | 10/2008 | Morgan et al. | |
| 7,434,967 | B2 * | 10/2008 | Dupre | F21S 8/026 362/366 |
| 7,476,008 | B2 | 1/2009 | Kay | |
| 7,478,931 | B2 | 1/2009 | Miletich et al. | |
| 7,484,866 | B1 | 2/2009 | Buse | |
| 7,530,705 | B2 | 5/2009 | Czech et al. | |
| 7,559,677 | B1 | 7/2009 | Dupre | |
| 7,618,166 | B1 | 11/2009 | Truax et al. | |
| 7,631,987 | B2 | 12/2009 | Wei | |
| 7,637,636 | B2 | 12/2009 | Zheng et al. | |
| 7,670,028 | B2 | 3/2010 | Liu et al. | |
| 7,703,951 | B2 | 4/2010 | Piepgras et al. | |
| 7,722,227 | B2 | 5/2010 | Zhang et al. | |
| 7,748,868 | B2 | 7/2010 | Patti et al. | |
| 7,753,562 | B2 | 7/2010 | Livesay et al. | |
| 7,766,518 | B2 | 8/2010 | Piepgras et al. | |
| 7,828,464 | B2 | 11/2010 | Wang et al. | |
| 7,832,901 | B2 | 11/2010 | Ladewig | |
| 7,857,492 | B2 | 12/2010 | Dixon | |
| 7,883,237 | B2 | 2/2011 | Zhang et al. | |
| 7,891,624 | B2 * | 2/2011 | Dittmer | F16M 11/04 248/292.12 |
| 7,896,529 | B2 | 3/2011 | Wronski et al. | |
| 7,905,633 | B2 | 3/2011 | Horng et al. | |
| 7,918,587 | B2 | 4/2011 | Hsu et al. | |
| 7,950,834 | B2 | 5/2011 | Dupre | |
| 7,959,332 | B2 | 6/2011 | Tickner et al. | |
| 7,993,034 | B2 | 8/2011 | Wegner | |
| 7,997,763 | B2 | 8/2011 | Giardina et al. | |
| 8,002,425 | B2 | 8/2011 | Russo et al. | |
| 8,021,013 | B2 | 9/2011 | Russo et al. | |
| 8,029,173 | B2 | 10/2011 | Ko | |
| 8,057,082 | B2 | 11/2011 | Seabrook | |
| 8,066,404 | B2 | 11/2011 | Song et al. | |
| 8,066,413 | B2 | 11/2011 | Czech et al. | |
| 8,070,316 | B2 | 12/2011 | Urano et al. | |
| 8,079,740 | B2 | 12/2011 | Huang et al. | |
| 8,100,565 | B2 | 1/2012 | Patti et al. | |
| 8,123,382 | B2 | 2/2012 | Patrick et al. | |
| 8,128,263 | B2 | 3/2012 | Higuchi et al. | |
| 8,182,116 | B2 | 5/2012 | Zhang et al. | |
| 8,215,805 | B2 | 7/2012 | Cogliano et al. | |
| 8,226,278 | B2 | 7/2012 | Ward et al. | |
| 9,004,728 | B2 * | 4/2015 | Thompson | F21S 8/026 362/145 |
| 9,039,254 | B2 * | 5/2015 | Danesh | F21V 21/30 362/147 |
| 9,134,016 | B2 * | 9/2015 | David | F21S 8/026 |
| 2003/0161153 | A1 | 8/2003 | Patti | |
| 2005/0168986 | A1 | 8/2005 | Wegner | |
| 2006/0250788 | A1 | 11/2006 | Hodge et al. | |
| 2008/0025031 | A1 | 1/2008 | Wronski et al. | |
| 2008/0112171 | A1 | 5/2008 | Patti et al. | |
| 2008/0175003 | A1 | 7/2008 | Tsou et al. | |
| 2008/0266883 | A1 | 10/2008 | Chen | |
| 2009/0046456 | A1 | 2/2009 | Urano et al. | |
| 2009/0086476 | A1 | 4/2009 | Tickner et al. | |
| 2009/0103308 | A1 | 4/2009 | Xu et al. | |
| 2009/0116254 | A1 | 5/2009 | Dupre | |
| 2009/0141494 | A1 | 6/2009 | Zhang et al. | |
| 2009/0196053 | A1 | 8/2009 | Ziobro et al. | |
| 2009/0268474 | A1 | 10/2009 | Ward et al. | |
| 2009/0279314 | A1 | 11/2009 | Wu et al. | |
| 2009/0296414 | A1 | 12/2009 | Moriyama et al. | |
| 2010/0002453 | A1 | 1/2010 | Wu et al. | |
| 2010/0014287 | A1 | 1/2010 | Chiang et al. | |
| 2010/0053950 | A1 | 3/2010 | Higuchl et al. | |
| 2010/0085766 | A1 | 4/2010 | Czech et al. | |
| 2010/0110660 | A1 | 5/2010 | Brukilacchio | |
| 2010/0110698 | A1 | 5/2010 | Harwood et al. | |
| 2010/0149822 | A1 * | 6/2010 | Cogliano | F21S 8/02 362/365 |
| 2010/0157602 | A1 | 6/2010 | Nichols | |
| 2010/0165643 | A1 | 7/2010 | Russo et al. | |
| 2010/0195327 | A1 | 8/2010 | Inoue et al. | |
| 2010/0246178 | A1 | 9/2010 | Giardina et al. | |
| 2011/0044038 | A1 | 2/2011 | Mo | |
| 2011/0051410 | A1 | 3/2011 | Liang | |
| 2011/0069501 | A1 | 3/2011 | Chou et al. | |
| 2011/0116276 | A1 | 5/2011 | Okamura et al. | |
| 2011/0134634 | A1 | 6/2011 | Gingrich, III et al. | |
| 2011/0141741 | A1 | 6/2011 | Engstrom et al. | |
| 2011/0164422 | A1 | 7/2011 | Chan | |
| 2011/0182067 | A1 | 7/2011 | Watanabe | |
| 2011/0211346 | A1 | 9/2011 | Ogawa et al. | |
| 2011/0249434 | A1 | 10/2011 | McQuistian et al. | |
| 2011/0317444 | A1 | 12/2011 | Chen | |
| 2012/0051069 | A1 | 3/2012 | Lim | |
| 2012/0069545 | A1 | 3/2012 | Choi et al. | |
| 2012/0320577 | A1 | 12/2012 | Wang | |
| 2013/0294077 | A1 | 11/2013 | Gabrius et al. | |
| 2014/0085912 | A1 | 3/2014 | David et al. | |
| 2014/0268836 | A1 | 9/2014 | Thompson | |

OTHER PUBLICATIONS

Non-Final Office Action for U.S. Appl. No. 13/828,543, mailed Aug. 18, 2014.

Office Action for Canadian Application No. CA 2,861,719, dated Oct. 7, 2014, 4 Pages.

Notice of Allowance for U.S. Appl. No. 13/833,597, mailed Jan. 30, 2015, 10 pages.

Notice of Allowance for Canadian Application No. CA 2,810,871, mailed Jan. 6, 2015, 1 page.

* cited by examiner

LIGHT ASSEMBLY

FIELD

Embodiments of the present invention relate to a light assembly utilizing injection molded components for recessed positioning within a ceiling and having a light engine that can be rotated within the ceiling.

BACKGROUND

Light engines for recessed positioning within a ceiling opening are typically constructed from sheet metal components and are locked in position over the opening such that the fixture cannot be rotated to adjust the directionality and distribution of the light emitted from the light engine. To the extent that light engines are capable of being rotated once installed in a ceiling, such rotation is typically limited to 360° and can typically only be effectuated using tools.

SUMMARY

Certain embodiments of the present invention provide a light assembly constructed from injection molded components that includes a light pan on which a light engine is mounted so as to direct light through the light pan opening and out of an opening in the ceiling. The light assembly is designed to permit the light engine to be rotated, in some embodiments beyond 360° and locked in position without the need for tools.

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

BRIEF DESCRIPTION OF THE FIGURES

Illustrative embodiments of the present invention are described in detail below with reference to the following drawing figures.

DETAILED DESCRIPTION

Figure 1:
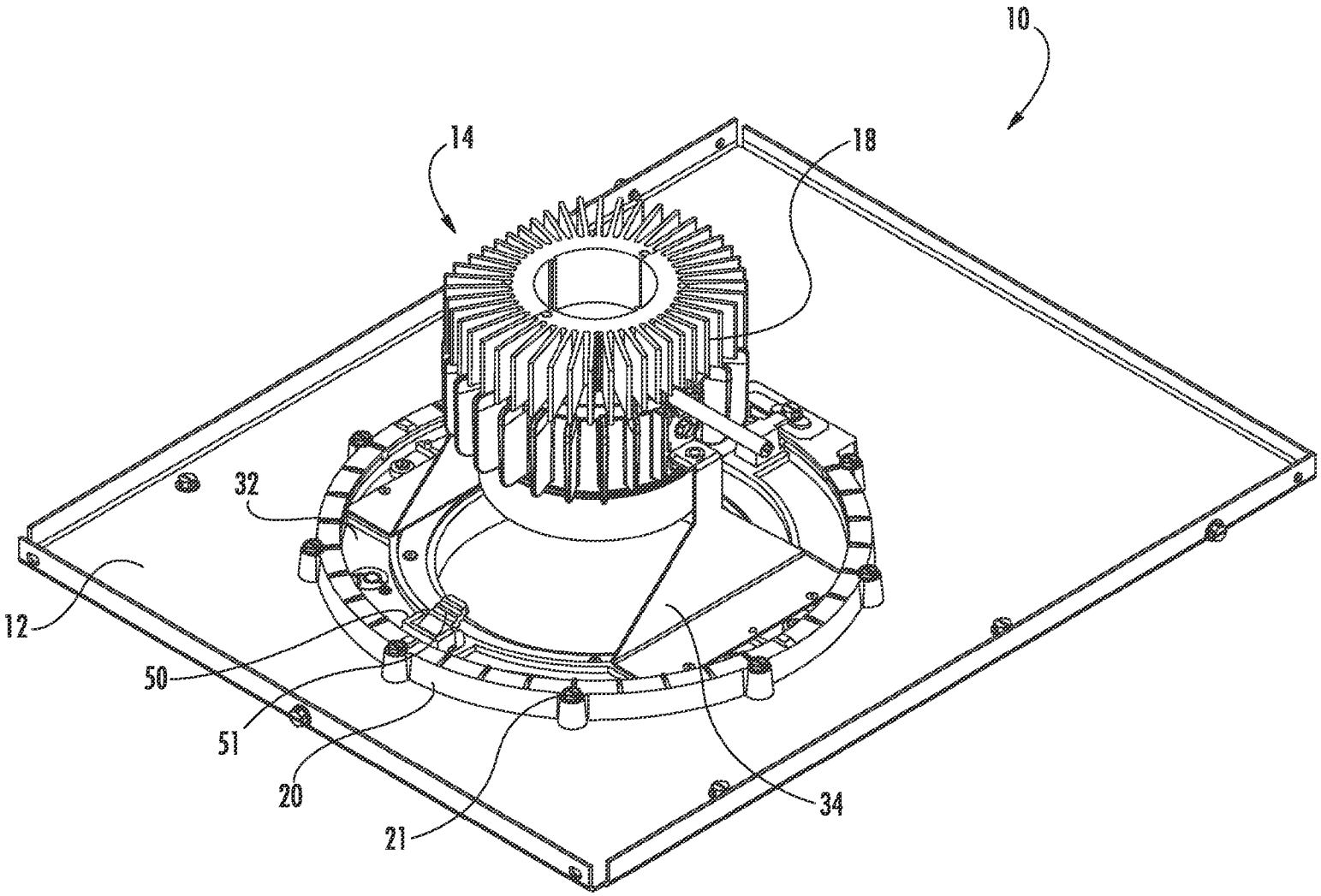
FIG. 1 is a perspective view of an embodiment of a light assembly.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of the light assembly 10 (one embodiment of which is shown assembled in FIG. 1) include a light pan 12 on which a light engine 14 is mounted so as to direct light through the light pan opening 16 and out of an opening in the ceiling. The light assembly 10 is designed to permit the light engine 14 to be rotated and locked into position without the need for tools. Thus, while tools certainly may be used, they need not be. In addition, the light assembly 10 includes an adjustable rotation limiting mechanism.

The illustrated light engine 14 generally includes a heat sink 18 and a light source (such as, but not limited to, light emitting diodes mounted on a printed circuit board, not shown) mounted to the heat sink 18. However, any light engine having any light source(s) may be used and embodiments of the invention are certainly not intended to be limited to the light engine 14 illustrated in the attached figures. By way only of example, the light engine could include the embodiments disclosed in U.S. patent application Ser. No. 13/828,543, filed Mar. 14, 2013 and entitled "Light Engine," the entirety of which is herein incorporated by reference.

In some embodiments, the light assembly 10 includes a rotation ring 32 disposed at least partially around an opening 16 in a light pan 12 and a mounting ring 20 positioned at least partially over the rotation ring 32 and attached to the light pan 12 so as to sandwich a portion of the rotation ring 32 between the pan 12 and the mounting ring 20. A light engine 14 is mounted on rotation ring 32 (via mounting brackets 34 which attach to bosses 36) so as to be suspended over the light pan 12 and emit light through the light pan opening 16. The light assembly 10 may also include an adjustable rotation limiting mechanism that includes (a) a rotation stop platform 22 attached to the mounting ring 20 where the rotation stop platform 22 includes a moveable stop 23 configured to move with respect to the rotation stop platform 22 to change a maximum rotation position and (b) a rotation stop unit 33 attached to the rotation ring 32 where the rotation stop unit 33 includes a rotation stop arm 35. The rotation stop arm 35 rotates with the rotation ring 32 and contacts the moveable stop 23 at the maximum rotation position thereby limiting rotation of the rotation ring 32 with respect to the mounting ring 20. Furthermore, the light assembly 10 may include a rotational position locking mechanism 50 attached to the rotation ring 32 that, when actuated, locks the rotation ring 32 in a rotational position relative to pan 12.

The light engine 14 is supported over the light pan opening 16 by two opposing upraised mounting brackets 34 mounted on the rotation ring 32. The mounting brackets 34 may be attached to rotation ring 32 by inserting fasteners into any number of bosses 36 provided on the rotation ring 32. However, other attachment mechanisms would be understood by one of skill in the art and are contemplated herein.

Mounting Ring

Figure 2:
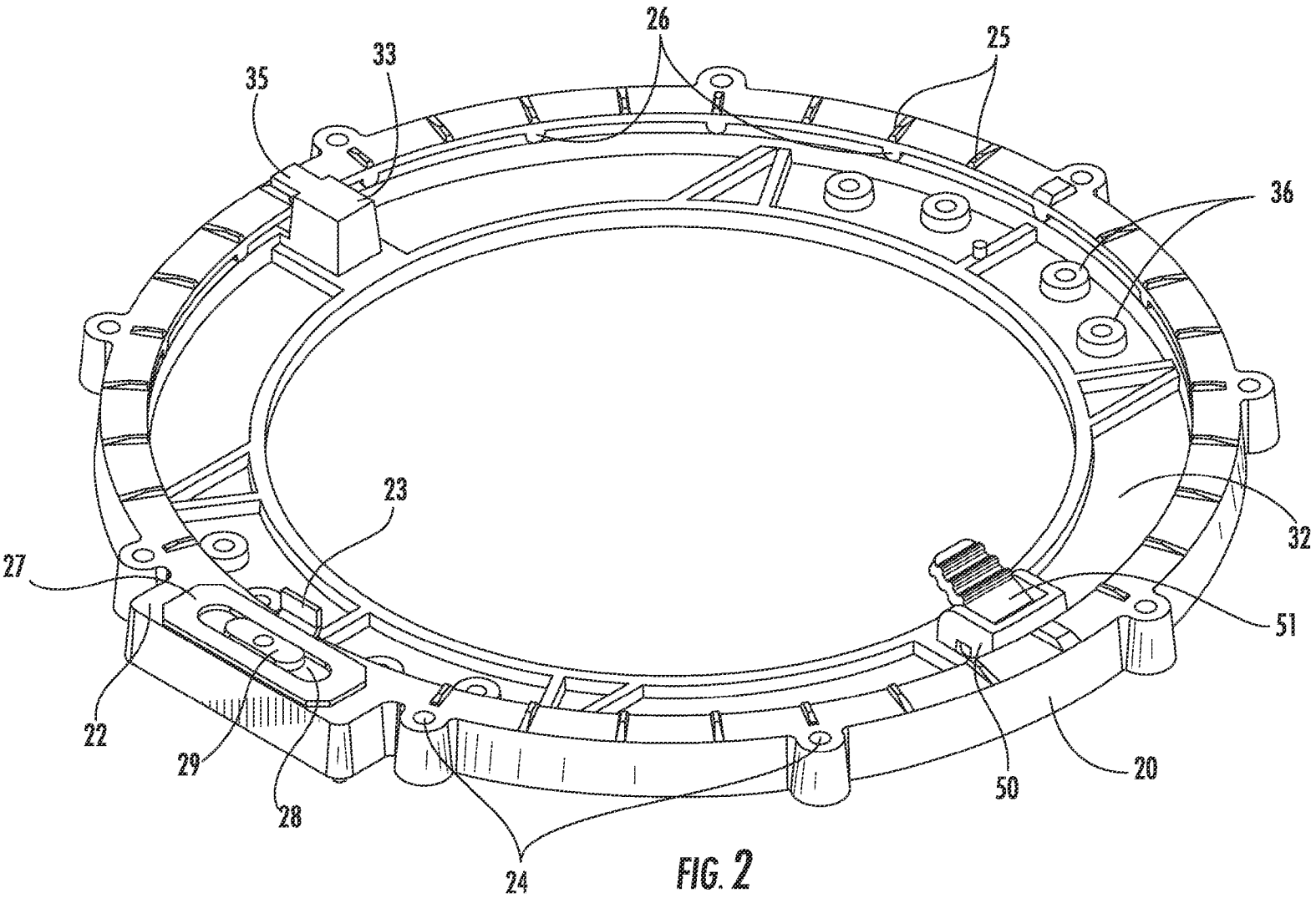
FIG. 2 is a perspective view of the mounting ring and the rotation ring of the light assembly of FIG. 1.
Figure 3:
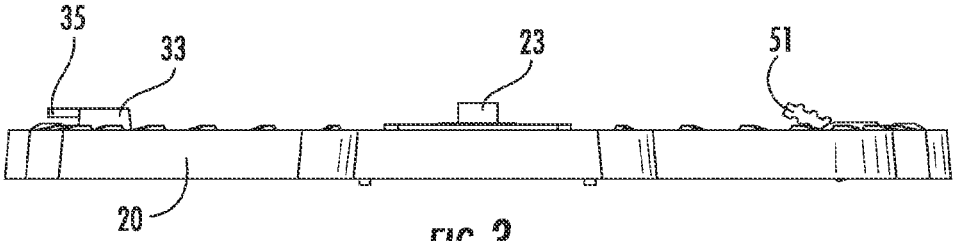
FIG. 3 is a side view of the mounting ring and rotation ring of FIG. 2.

As shown in FIG. 1, the mounting ring 20 is mounted on the light pan 12 at least partially about the light pan opening 16. The mounting ring 20 may be fixedly mounted onto the light pan 12 such as with screws or other mechanical fasteners 21. As illustrated in FIG. 2, in some embodiments, the mounting ring 20 includes at least one boss 24 through which a mechanical fastener 21 (such as a screw) may pass to mount the mounting ring 20 to the light pan 12.

Figure 9:
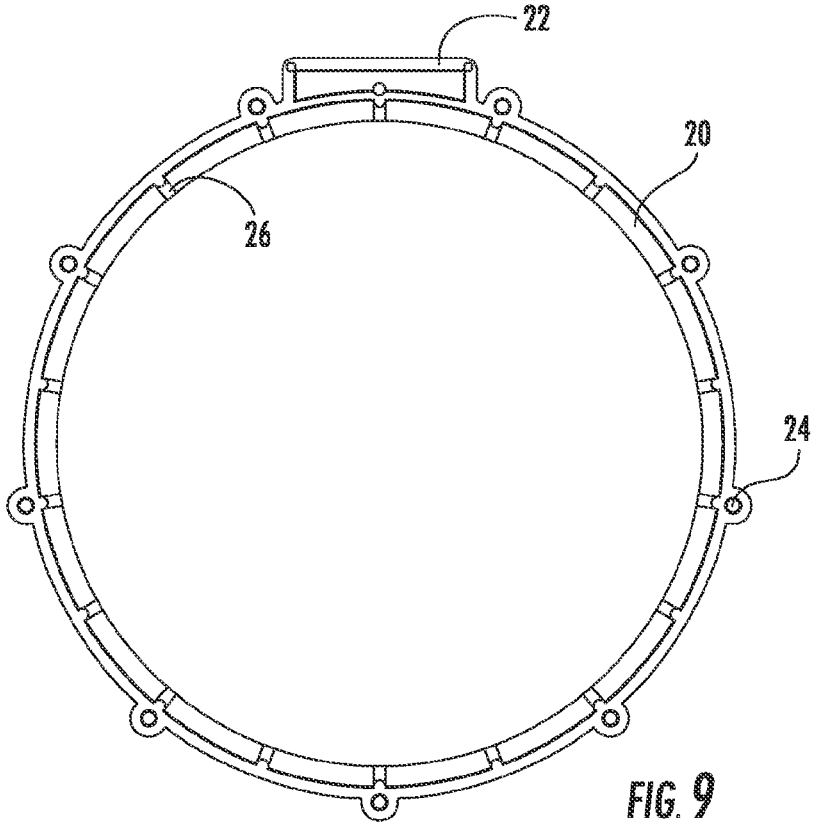
FIG. 9 is a bottom view of the mounting ring of FIG. 2.

The mounting ring 20 may include one or more protrusions 26 on the underside thereof that create discrete points of contact at the interface with the rotation ring 32 (see FIGS. 2 and 9). As shown in FIG. 2, the one or more protrusions 26 contact an upper surface of rotation ring 32. Limiting the locations (and associated surface area) of contact between the two components acts to reduce friction and ensure that rotation ring 32 can easily be rotated by hand.

Figure 8:
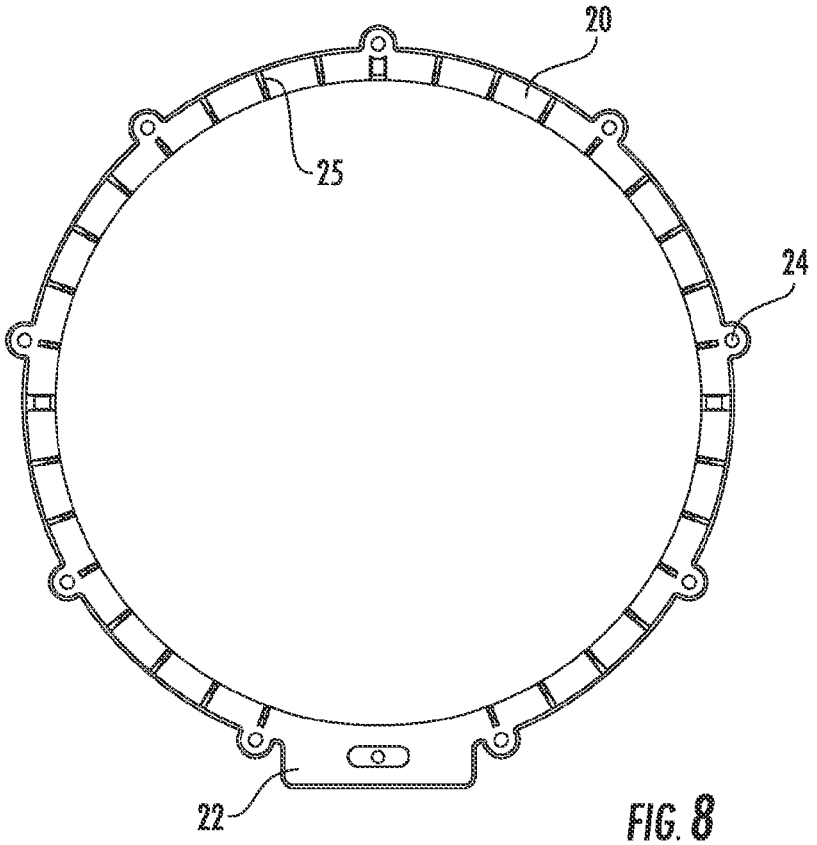
FIG. 8 is a top view of the mounting ring of FIG. 2.

As shown in FIGS. 2 and 8, the mounting ring 20 may include upraised degree indicia 25 for providing a tactile indication of rotational status of the rotation ring 32 relative to the mounting ring 20. In this way, a user may reach through light pan opening 16, rotate the light engine 14 attached to the rotation ring 32, and gauge its relative rotational orientation by reference to the indicia 25 provided on mounting ring 20. The degree indicia 25 may be provided in various increments, such as every 10° and major axes (e.g., 0°, 90°, 180°, 270°) may include larger or more prominent indicia. Using the degree indicia 25 may facilitate orienting multiple units consistently (i.e., at the same angle and/or pointed at the same object) within an architectural space.

Figure 10:
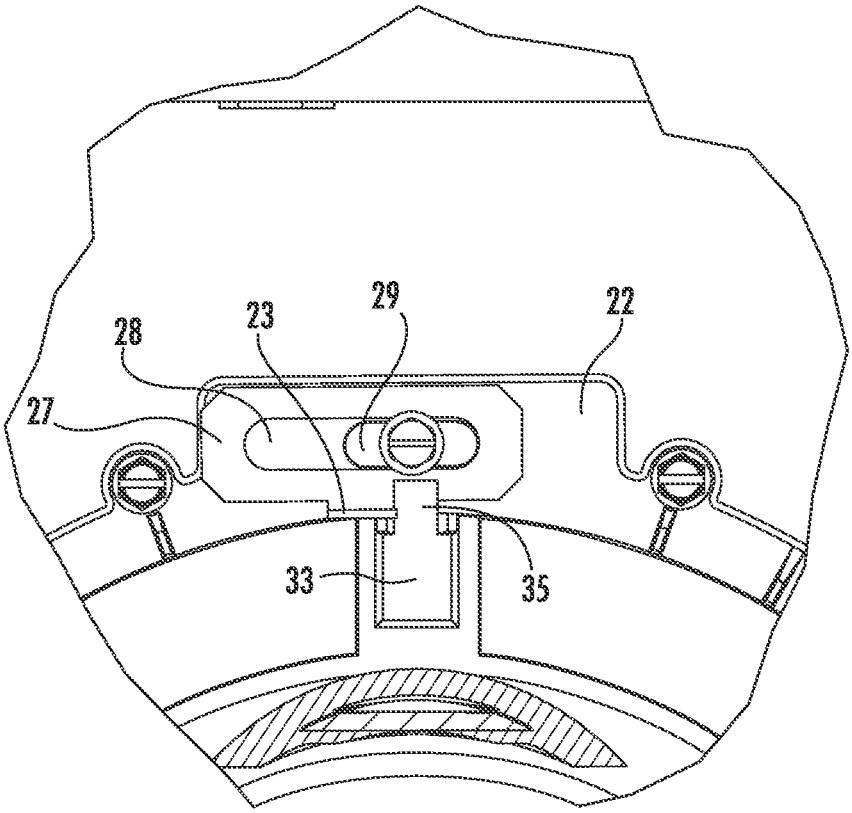
FIG. 10 is an enlarged partial view of the adjustable rotation limiting mechanism of FIG. 2.

As shown in FIGS. 2 and 8-10, the mounting ring 20 may include a rotation stop assembly that comprises a rotation stop platform 22 and a moveable stop 23 that is configured to limit the amount of rotation of the rotation ring 32 with respect to the mounting ring 20 (rotation is limited when rotation stop arm 35 of rotation stop unit 33 contacts moveable stop 23). Although rotation stop platform 22 is shown integrally formed with mounting ring 20, rotation stop platform 22 may be removeably attached to the mounting ring 20. A projection 29 extends from the upper surface of the rotation stop platform 22. The moveable stop 23 is integrally formed with or attached to a sliding plate 27 having a slot 28 in which the projection 29 seats. Moveable stop 23 is configured to move with respect to rotation stop platform 22 via movement of the sliding plate 27 along a longitudinal direction of projection 29. More specifically, when the rotation stop arm 35 of the rotation ring 32 contacts the moveable stop 23, attempts to further rotate the rotation ring 32 causes the rotation stop arm 35 to press against the moveable stop 23 and associated sliding plate 27. Due to this interaction, moveable stop 23 and sliding plate 27 move (in the longitudinal direction of slot 28) relative to the projection 29. Moveable stop 23 and sliding plate 27 are shown in a central location in FIG. 2 (i.e., projection 29 is approximately centered in slot 28) while FIG. 10 shows moveable stop 23 in one extreme position (shown at a far left position in FIG. 10) to allow maximum counter-clockwise rotation (or a minimum clockwise rotation). The moveable stop 23 and sliding plate 27 may be located in an infinite number of positions with respect to projection 29, for example, from the position shown in FIG. 10 to the opposite extreme position (i.e., at the far right side of rotation stop platform 22). Movement of sliding plate 27 relative to projection 29 permits rotation of the rotation ring 32 beyond 360° (e.g., 363°) with respect to mounting ring 20. The extent of such hyper-rotation is dependent upon the geometry of the slot 28 and projection 29.

Rotation Ring

In some embodiments the outer periphery of the rotation ring 32 is sandwiched between light pan 12 and mounting ring 20. Such an arrangement prevents the rotation ring 32 from moving in the vertical direction but still allows the rotation ring 32 to rotate about a vertical axis. To adjust the rotational orientation of the light engine 14 relative to the light pan 12, a user would reach up through the light pan opening 16 and rotate the rotation ring 32 (and associated light engine 14). In this way, the entire assembly (with associated light engine 14) rotates relative to the mounting ring 20 to orient the light engine 14 in the desired rotational orientation.

As described above and as shown in FIG. 2, rotation ring 32 may include a rotation stop unit 33 that includes a rotation stop arm 35 configured to engage the rotation stop platform 22 of the mounting ring 20. In particular, when rotation ring 32 rotates, rotation stop arm 35 contacts moveable stop 23 to limit rotation of rotation ring 32 with respect to mounting ring 20. The rotation stop unit 33 may be integral to rotation ring 32 or may be replaceably attached.

Figure 4:
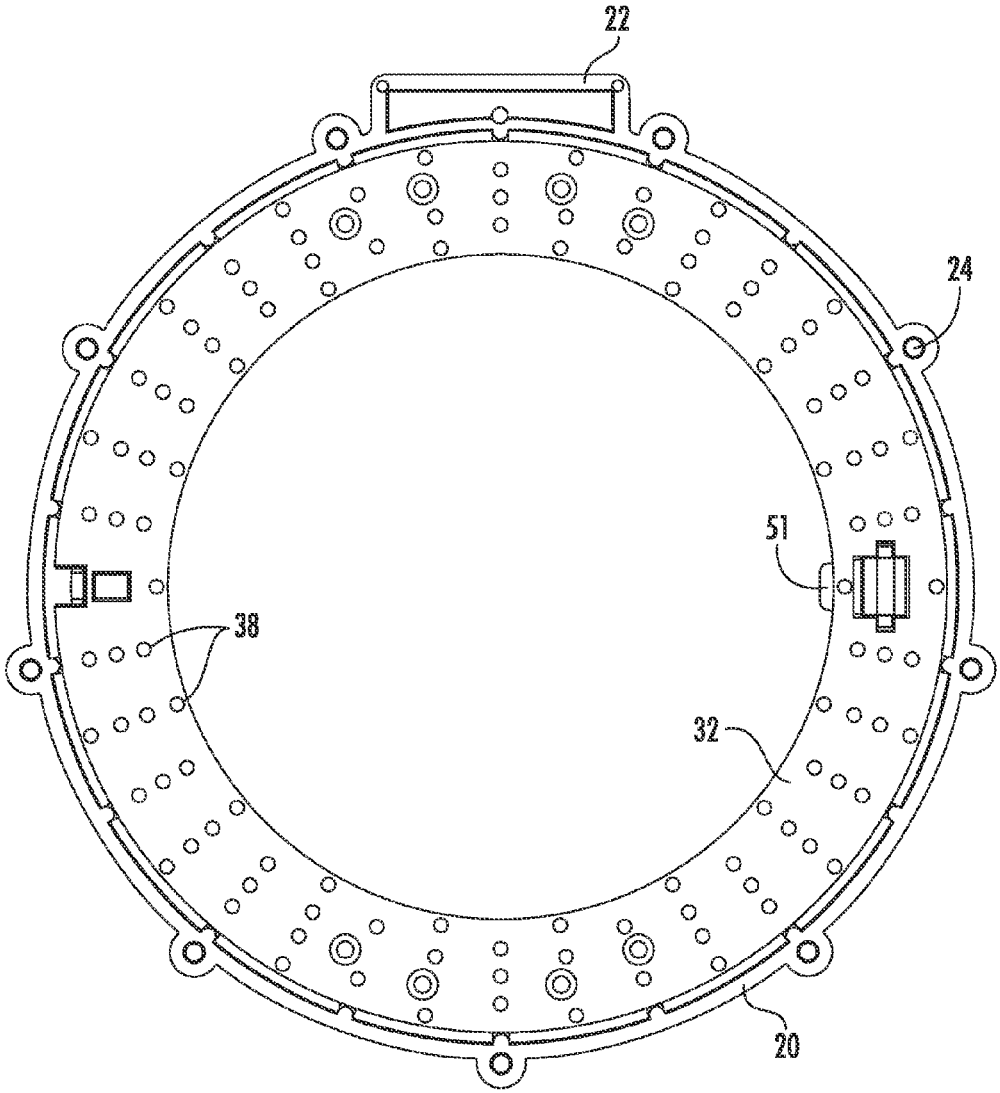
FIG. 4 is a bottom view of the mounting ring and rotation ring of FIG. 2.
Figure 5:
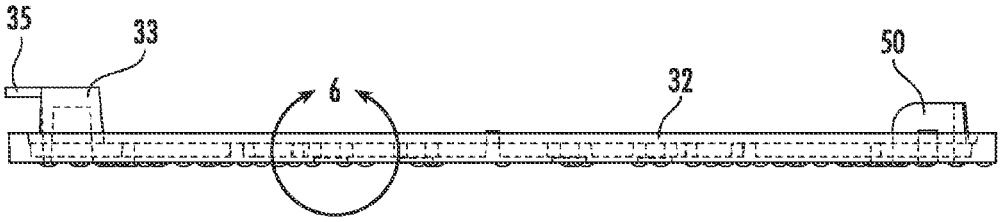
FIG. 5 is a side view of the rotation ring of FIG. 2.
Figure 6:
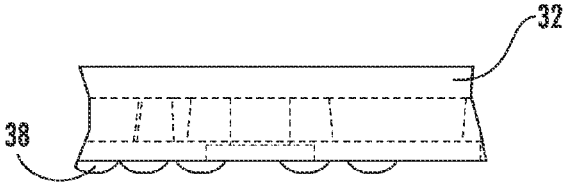
FIG. 6 is detailed view of area 6 of FIG. 5.
Figure 7:
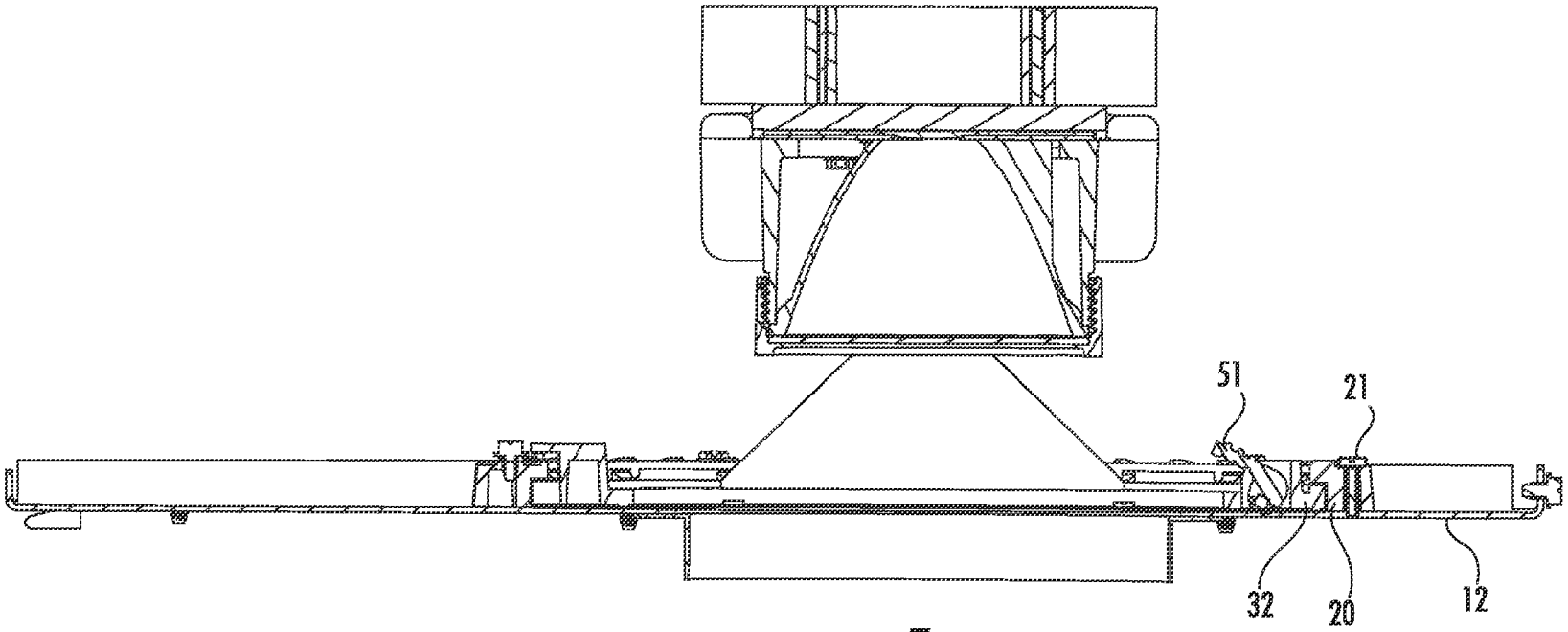
FIG. 7 is a cross-sectional view of the light assembly of FIG. 1.
Figure 11:
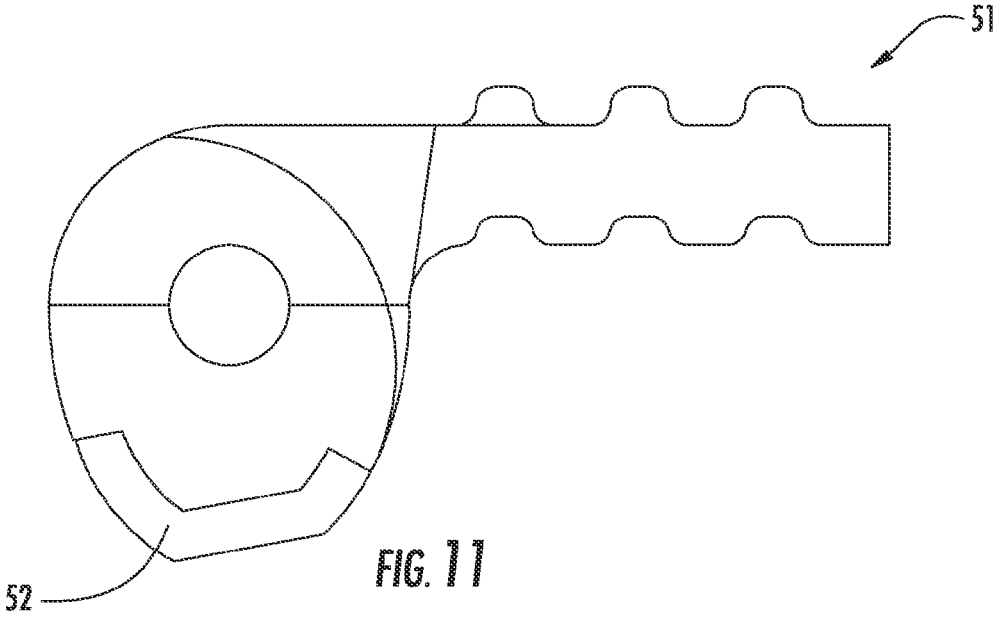
FIG. 11 is a side view of the cam lock arm of the light assembly of FIG. 1.

As shown in FIGS. 1, 2, 7, and 11, a rotational position locking mechanism 50 may be pivotably attached to the rotation ring 32. In one embodiment, the rotational position locking mechanism 50 includes a cam lock arm 51, that, when depressed, causes the rotational position locking mechanism 50 to engage the surface of the pan 12 to rotationally lock the rotation ring 32 in place. While the rotational position locking mechanism 50 may be formed entirely of a high-friction material (e.g., a thermoplastic elastomer (TPE), such as Santoprene® marketed by ExxonMobil), in some embodiments the cam lock arm 51 is formed of a metallic or polymeric material (including, but not limited to aluminum, stainless steel, aramid fibers, polycarbonate, polypropylene, plastic, composite materials, other thermoplastics, or other similar materials) and a friction insert 52 of high-friction material is molded onto or otherwise attached to the cam lock arm 51, as shown in FIG. 11. In such embodiments, when the cam lock arm 51 is depressed, the friction insert 52 engages the pan 12 to restrict further rotational movement of the rotation ring 32 (i.e., see FIG. 7). The bottom surface of the rotation ring 32 may include a plurality of protrusions 38 or detents that simulate ball bearings for limiting points of contact with light pan 12 and thereby reducing friction (see FIGS. 4-6). As shown in FIG. 6, the protrusions 38 extend from the lower surface of rotation ring 32 to contact an upper surface of light pan 12. Limiting the locations (and associated surface area) of contact between the two components acts to reduce friction and ensure that rotation ring 32 can easily be rotated by hand.

The mounting ring 20 and rotation ring 32 may be formed of the same or different materials including, but not limited to, self-lubricating plastic, aluminum, stainless steel, aramid fibers, polycarbonate, polypropylene, other plastic materials, composite materials, thermoplastic, or other similar materials. In some embodiments, the mounting ring 20 is formed from injection molded Polyoxymethylene (POM), one example of which is marketed as Delrin® by DuPont™.

Injection molding (using materials such as POM) yields more precise tolerances that can be more carefully controlled compared to the tolerances associated with typical sheet metal components. Thus, the injection molded components form an assembly that can more effectively be selectively locked to prevent rotational movement.

Furthermore, the use of materials that are self-lubricating and/or have a low coefficient of friction ensure that the mounting ring 20 and rotation ring 32 can slide easily relative to each other and with minimal required force. For example, POM has the following qualities: high abrasion resistance, low coefficient of friction, high heat resistance, good electrical and dielectric properties, and low water absorption.

The foregoing is provided for purposes of illustrating, explaining, and describing embodiments of the present invention. Further modifications and adaptations to these embodiments will be apparent to those skilled in the art and may be made without departing from the scope or spirit of the invention. Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the invention.

We claim:

1. A light assembly comprising:

a light pan having a pan opening;

a rotation ring comprising an upper surface and a lower surface and disposed at least partially around the pan opening;

a mounting ring comprising an upper surface and a lower surface and disposed at least partially around the pan opening and positioned over a portion of the rotation ring such that the portion of the rotation ring is sandwiched between the light pan and the mounting ring and such that the rotation ring is rotatable relative to the mounting ring, wherein the mounting ring is secured to the light pan;

a light engine mounted on the rotation ring and oriented so as to emit light through the pan opening; and an adjustable rotation limiting mechanism that includes (a) a rotation stop platform provided on the mounting ring, the rotation stop platform comprising a moveable stop and (b) a rotation stop unit provided on the rotation ring, the rotation stop unit including a rotation stop arm, wherein the rotation stop arm rotates with the rotation ring and contacts the moveable stop to prevent further rotation of the rotation ring with respect to the mounting ring.

2. The light assembly of claim 1, further comprising a rotational position locking mechanism provided on the rotation ring, the rotational position locking mechanism comprising a cam lock arm and a friction insert that engages the light pan when the cam lock arm is depressed to lock the rotation ring in a rotational position relative to the mounting ring.

3. The light assembly of claim 2, wherein the cam lock arm is accessible to a user reaching through the pan opening.

4. The light assembly of claim 1, wherein the mounting ring and the rotation ring are formed from an injection molded material.

5. The light assembly of claim 4, wherein the injection molded material is Polyoxymethylene.

6. The light assembly of claim 1, wherein the moveable stop is configured to move relative to the rotation stop platform to permit rotation of the rotation ring relative to the mounting ring in excess of 360°.

7. The light assembly of claim 6, wherein the rotation stop platform further comprises a projection that engages a sliding plate attached to the moveable stop.

8. The light assembly of claim 6, wherein the moveable stop is configured to move relative to the rotation stop platform to permit rotation of the rotation ring relative to the mounting ring of about 363°.

9. The light assembly of claim 1, wherein:

an interface is formed between the mounting ring and the rotation ring;

the mounting ring comprises a plurality of protrusions on the lower surface of the mounting ring; and the upper surface of the rotation ring contacts only the plurality of protrusions on the lower surface of the mounting ring at the interface.

10. The light assembly of claim 1, wherein the mounting ring comprises a plurality of upraised degree indicia on the upper surface of the mounting ring.

11. The light assembly of claim 1, wherein the rotation ring comprises protrusions on the lower surface of the rotation ring that reduce contact between the rotation ring and the light pan.

12. A light assembly comprising:

a light pan having a pan opening;

a rotation ring comprising an upper surface and a lower surface and disposed at least partially around the pan opening;

a mounting ring comprising an upper surface and a lower surface and disposed at least partially around the pan opening and positioned over a portion of the rotation ring such that the portion of the rotation ring is sandwiched between the light pan and the mounting ring and such that the rotation ring is rotatable relative to the mounting ring, wherein the mounting ring is secured to the light pan;

a light engine mounted on the rotation ring and oriented so as to emit light through the pan opening;

an adjustable rotation limiting mechanism that includes (a) a rotation stop platform provided on the mounting ring, the rotation stop platform comprising a moveable stop configured to move relative to the rotation stop platform to permit rotation of the rotation ring relative to the mounting ring in excess of 360° and (b) a rotation stop unit provided on the rotation ring, the rotation stop unit including a rotation stop arm; and a rotational position locking mechanism provided on the rotation ring, the rotational position locking mechanism comprising a cam lock arm and a friction insert that engages the light pan when the cam lock arm is depressed to lock the rotation ring in a rotational position relative to the mounting ring, wherein the rotation stop arm rotates with the rotation ring and contacts the moveable stop to prevent further rotation of the rotation ring with respect to the mounting ring.

13. The light assembly of claim 12, wherein the cam lock arm is accessible to a user reaching through the pan opening.

14. The light assembly of claim 12, wherein the mounting ring and the rotation ring are formed from an injection molded material.

15. The light assembly of claim 12, wherein the rotation stop platform further comprises a projection that engages a sliding plate attached to the moveable stop.

16. The light assembly of claim 12, wherein the moveable stop is configured to move relative to the rotation stop platform to permit rotation of the rotation ring relative to the mounting ring of about 363°.

17. The light assembly of claim 12, wherein:

an interface is formed between the mounting ring and the rotation ring;

the mounting ring comprises a plurality of protrusions on the lower surface of the mounting ring; and the upper surface of the rotation ring contacts only the plurality of protrusions on the lower surface of the mounting ring at the interface.

18. A method of positioning a light assembly, the method comprising:

(i) providing a light assembly comprising:

a light pan having a pan opening;

a rotation ring comprising an upper surface and a lower surface and disposed at least partially around the pan opening;

a mounting ring comprising an upper surface and a lower surface and disposed at least partially around the pan opening and positioned over a portion of the rotation ring such that the portion of the rotation ring is sandwiched between the light pan and the mounting ring and such that the rotation ring is rotatable relative to the mounting ring, wherein the mounting ring is secured to the light pan;

a light engine mounted on the rotation ring and oriented so as to emit light through the pan opening; and an adjustable rotation limiting mechanism that includes (a) a rotation stop platform provided on the mounting ring, the rotation stop platform comprising a moveable stop and (b) a rotation stop unit provided on the rotation ring, the rotation stop unit including a rotation stop arm, wherein the rotation stop arm rotates with the rotation ring and contacts the moveable stop to prevent further rotation of the rotation ring with respect to the mounting ring; and (ii) rotating the rotation ring with respect to the mounting ring to a desired rotational position.

19. The method of claim 18, wherein rotating the rotation ring comprises rotating the rotation ring until the rotation stop arm contacts the moveable stop and then continuing to rotate so as to move the moveable stop.

20. The method of claim 18, further comprising actuating a rotational position locking mechanism to lock the rotation ring in a rotational position relative to the mounting ring, wherein the rotational position locking mechanism comprises a cam lock arm and a friction insert that engages the light pan when the cam lock arm is depressed.

* * * * *